US006659602B2

(12) United States Patent
Izawa et al.

(10) Patent No.: US 6,659,602 B2
(45) Date of Patent: Dec. 9, 2003

(54) INK-JET PRINTER ARRANGEMENT FOR PRINTING BOTH SIDES OF A WEB

(75) Inventors: Hideo Izawa, Sakura (JP); Takao Namiki, Sakura (JP)

(73) Assignee: Miyakoshi Printing Machinery Co., Ltd., Chiba (JP)

( * ) Notice: Subject to any disclaimer, the term of this patent is extended or adjusted under 35 U.S.C. 154(b) by 0 days.

(21) Appl. No.: 10/058,729

(22) Filed: Jan. 30, 2002

(65) Prior Publication Data

US 2002/0105571 A1 Aug. 8, 2002

(30) Foreign Application Priority Data

Feb. 8, 2001 (JP) ..... P2001-031727

(51) Int. Cl.[7] ..... B41J 2/01
(52) U.S. Cl. ..... 347/102
(58) Field of Search ..... 347/16, 104, 105, 347/153, 154, 102, 101; 399/278, 288, 306, 329, 364, 374

(56) References Cited

U.S. PATENT DOCUMENTS 4,165,686 A * 8/1979 Borelli et al. ..... 101/DIG. 37
4,591,884 A * 5/1986 Miyamoto et al. ..... 347/153
4,974,035 A * 11/1990 Rabb et al. ..... 399/364
4,990,965 A * 2/1991 Kiya ..... 271/186
5,001,500 A * 3/1991 Wolfberg et al. ..... 101/211
5,369,480 A * 11/1994 Isobe ..... 347/130
5,764,263 A * 6/1998 Lin ..... 347/101
5,784,077 A * 7/1998 Silverbrook ..... 347/2
5,799,137 A * 8/1998 Broddin et al. ..... 358/1.18
5,860,053 A * 1/1999 Stemmle ..... 399/364
6,101,364 A * 8/2000 Boehmer et al. ..... 271/186

FOREIGN PATENT DOCUMENTS

JP 8-216467 8/1996

* cited by examiner

*Primary Examiner*—Stephen D. Meier
*Assistant Examiner*—Leonard Liang
(74) *Attorney, Agent, or Firm*—Wenderoth, Lind & Ponack, L.L.P.

(57) ABSTRACT

An apparatus is operable to print both sides of a web using two sets of ink-jet printers. A first set of printers are aligned horizontally, and so are the second set, with a vertical spacing between the first set and the second set. Paid out from its roll, the web is first fed forwardly past the first set of ink-jet printers so as to be printed on one side thereof, then reversely past the second set to be printed on the other side. The web can be guided solely by parallel rollers without the use of turning bars.

9 Claims, 2 Drawing Sheets

INK-JET PRINTER ARRANGEMENT FOR PRINTING BOTH SIDES OF A WEB

BACKGROUND OF THE INVENTION

This invention relates to an apparatus for printing both sides of a web of paper or like printable material, and particularly to such a double-side printing apparatus employing an ink-jet printer or printers for printing each side of the web.

Ink-jet printers by reason of their very construction presuppose use with their printing heads oriented downwardly. This operational requirement peculiar to ink-jet printers has imposed limitations upon their arrangement in use for printing both sides of a web. The opposite sides of the web are not printable concurrently, but only one after the other.

Japanese Unexamined Patent Publication No. 8-216467 suggests an arrangement in which a set of, for example, four ink-jet printers are aligned in the traveling direction of the web, and another such set in side-by-side relation to the first recited set. All the printers have their printing heads oriented downwardly. The web is first guided past the first set of printers to have one side thereof printed, and then turned aside and back past the second set of printers to have the other side printed. This conventional side-by-side arrangement of the two sets of ink-jet printers offers the advantage of reduction in the dimension of the apparatus in the traveling direction of the web from the supply station to the delivery station.

Offsetting this advantage of the prior art is the use of turning bars for turning aside and reversing the web from one set of ink-jet printers to the other. The web when traveling over the turning bars is particularly prone to the frictional development of static electricity, as well as lateral displacement or meandering. Another problem is that, arranged side by side, the two sets of ink-jet printers adds to the transverse, or one horizontal, dimension of the apparatus. The greater transverse, rather than vertical, dimension is undesirable because it is tantamount to a greater floor space requirement of the apparatus.

SUMMARY OF THE INVENTION

The object of the present invention is, in a double-side printing apparatus of the kind defined, to eliminate turning bars. Thus, parallel guide rollers only are used to guide the web from one printing means, such as an ink-jet printer or set of such printers, to another.

Another object of the invention is to reduce the lateral dimension, and therefore floor space requirement, of the doubleside printing apparatus to a minimum.

Still another object of the invention is to dry the printings on the web surfaces immediately after they have been made, with the drying means compactly arranged so as not to add to the floor space requirement of the apparatus.

Summarized in its perhaps broadest aspect, the invention concerns a double-side printing apparatus comprising a first printing mechanism for printing one side of the web, and a second printing mechanism for printing the other side of the web. The first and the second printing mechanisms are spaced from, and in register with, each other in a prescribed direction. Also included are guides for guiding the web past the first and the second printing mechanisms one after the other.

In the preferred embodiment of the present invention, the first and the second printing mechanisms each take the form of a series of ink-jet printers. Both series of ink-jet printers extend horizontally, with a vertical spacing therebetween, and with their printing heads all directed downwardly. The web is first threaded in a forward direction (i.e. from infeed toward delivery) past one series of ink-jet printers, then reversed to travel backwardly past the other series of ink-jet printers, and then reversed again to travel toward the delivery.

Thus, the web can have its opposite sides printed while traveling along a path that is contained in one vertical plane. No turning bars are needed, and only parallel rollers suffice, for threading the web past the two vertically-spaced series of printers. The web therefore does not produce static electricity by frictionally traveling over turning bars, and thus does not attract the fine dust particles that invariably fill the printing plant air.

Furthermore, as the two series of ink-jet printers are arranged one over the other, the apparatus according to the invention is materially reduced in lateral dimension compared with the prior art in which the two series were in side-by-side arrangement. Although somewhat increased in height, a factor that causes little or no inconvenience, the apparatus according to the invention gains a far more pronounced advantage of occupying significantly less floor area.

The dispensation with turning bars, made possible by this invention, leads to a simpler, more streamlined path of the web. As a consequence, not only is the apparatus simplified in construction, but the images printed by the respective ink-jet printers are bound to achieve a higher degree of registration.

A further feature of the invention resides in a device for drying the printings made on both sides of the web. In the preferred embodiment, the drying device takes the form of drums around which the web is guided. Each drum is arranged downstream of one series of ink-jet printers, and both drums are inconspicuously positioned in only one drier zone located under the two series of ink-jet printers. The drum driers are also well calculated to keep the space requirement of the apparatus at a minimum.

The above and other objects, features and advantages of this invention will become more apparent, and the invention itself will best be understood, from a study of the following description and appended claims, with reference to the attached drawings showing the preferred embodiment of the invention.

DESCRIPTION OF THE PREFERRED EMBODIMENT

Figure 1:
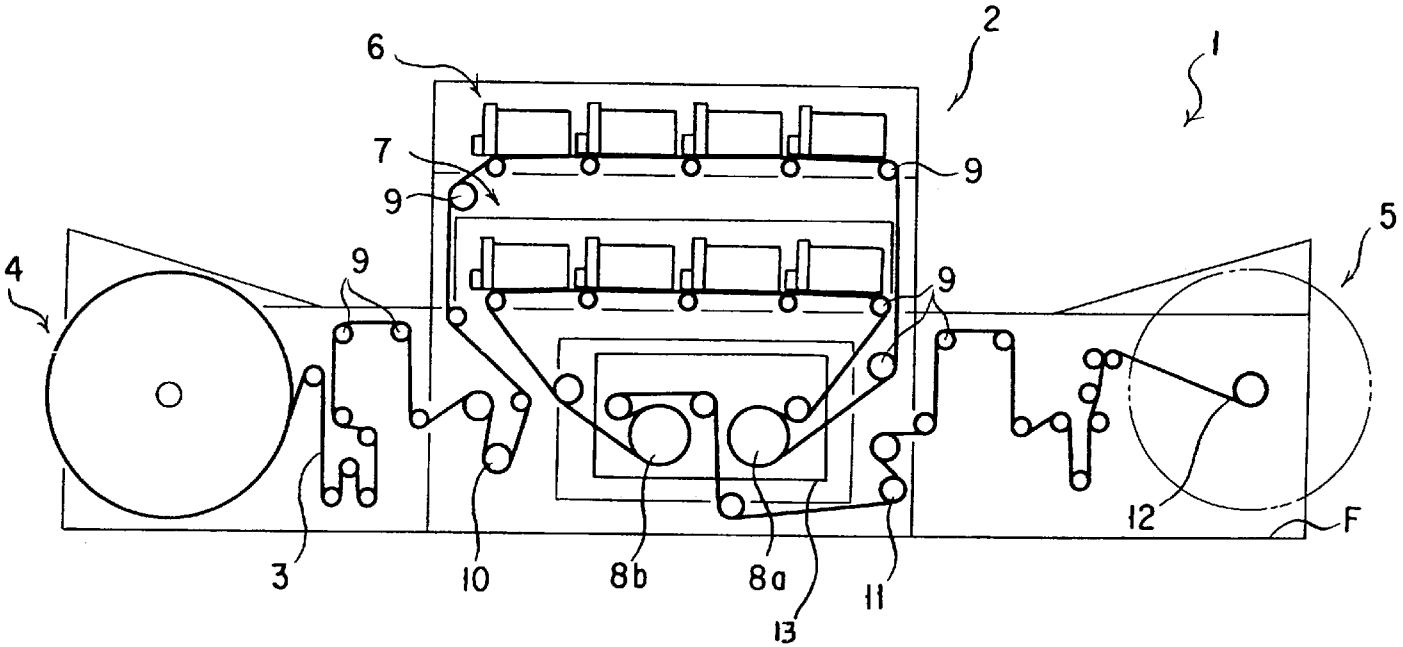
FIG. 1 is a schematic side elevation of the double-side printing apparatus constructed in accordance with the novel concepts of this invention.
Figure 2:
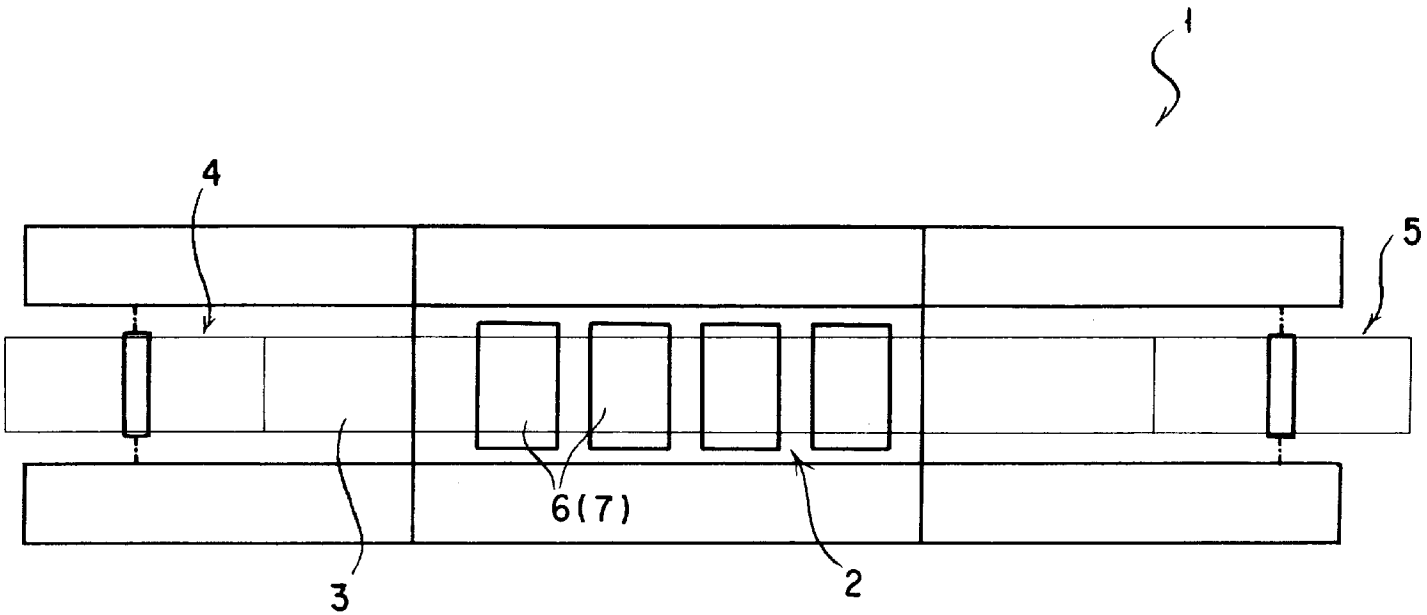
FIG. 2 is a schematic top plan of the double-side printing apparatus of FIG. 1.

The present invention will now be described more specifically as embodied in the double-side printing apparatus shown in both FIGS. 1 and 2 of the attached drawings and generally designated with reference number 1. The apparatus 1 has a double-side printing station 2 through which a web 3 of paper travels on its way from an infeed station 4 to a delivery station 5. Hereinafter in this specification, the directional terms such as "forward" and "backward" or "reverse" as well as derivatives thereof will be used in reference to the traveling direction of the web 3 from infeed station 4 to delivery station 5. Specifically, the web travels forwardly from the infeed station to the delivery station, and backwardly or reversely the other way around. Further, the directional terms "horizontal" and "vertical" as well as derivatives thereof will be used with the understanding that the apparatus 1 is laid on the floor F, which of course is horizontal.

At the double-side printing station 2 there are provided a set of, for example, four ink-jet printers 6 and another such set of ink-jet printers 7 for printing the opposite sides of the web 3. The first set of ink-jet printers 6 are aligned horizontally in a vertical plane containing the infeed station 4 and the delivery station 5. Spaced downwardly from the first set of ink-jet printers 6, the second set of ink-jet printers 7 are similarly aligned horizontally in the same vertical plane therewith. The two sets of ink-jet printers 6 and 7 are all oriented so as to face downwardly. It is understood that the positions of all the ink-jet printers 6 and 7 are conventionally independently adjustable both longitudinally and transversely of the web 3. As is also conventional in the art, an optical sensor, not shown, may be provided for automatically setting the ink-jet printers 6 and 7 into operation upon sensing a marking on the web, although the printers may be more conventionally controlled.

Also provided at the printing station 2 are a first drum drier 8*a* for drying the printings made on one side of the web 3 by the first set of ink-jet printers 6, and a second drum drier 8*b* for drying the printings made on the other side of the web by the second set of ink-jet printers 7. Both drum driers 8*a* and 8*b* are compactly disposed under the ink-jet printers 6 and 7, occupying the same position transversely of the web 3. In other words, as shown in FIG 1, both driers 8*a* and 8*b* are arranged in one drier zone 13 stacked in a vertical direction with ink-jet printers 6 and 7.

For guiding the web 3 from infeed station 4 to delivery station 5 through the printing station 2, a series of guide rollers 9 are strategically arranged at points of vantage, all extending parallel to each other. At the printing station 2, the web 3 is guided by the guide rollers 9 to travel in one direction first forwardly under the first set of ink-jet printers 6, then down and around the first drum drier 8*a*, then up and backwardly under the second set of ink-jet printers 7, then down and around the second drum drier 8*b*, and then under the first drum drier 8*a* toward the delivery station 5. Reference number 10 and 11 indicate drawing rollers laid parallel to the guide rollers 9. The first drawing roller 10 is situated adjacent to the entrance of printing station 2, and the second drawing roller 11 is adjacent to the exit of the printing station 2, although these drawing rollers could be disposed respectively at the infeed station 4 and the delivery station 5. The drum driers 8*a* and 8*b* could also be provided outside the printing station 2.

The operation of the double-side printing apparatus 1 of the foregoing construction will be set forth hereinbelow on the assumption that the web 3 is unwound from its roll with its rear side directed upwardly as pictured in FIG. 1. The web 3 is to travel throughout the printing station 2 under a prescribed degree of tension imposed by the drawing rollers 10 and 11. First, going forwardly under the first set of ink-jet printers 6 with its rear side upward, the web 3 will thereby be printed on this rear side. Then the web 3 will be directed downwardly and travel around the first drum drier 8*a*, which is in rotation, with its front side held against the first drum drier 8*a*. The printings made on the rear side of the web 3 by the first set of ink-jet printers 6 will therefore be dried without the danger of being rubbed against the first drum drier 8*a* and thereby smeared.

Then, going upwardly from the first drum drier 8*a*, the web 3 will travel backwardly under the second set of ink-jet printers 7, this time with its front side upward, so that this front side of the web will be printed. Then the web 3 will be guided downwardly and around the second drum drier 8*b*. Now, the rear side of the web will come into contact with the second drum drier 8*b*, so that the printings on its front side will be dried without being stained.

After being dried, the web 3 will travel forwardly toward the delivery station 5 by being pulled by the second drawing roller 11. The delivery station 5 is herein shown to have a takeup reel 12 for winding up the printed web 3.

It is now apparent that the various stated objects of this invention have been fully accomplished by the, representative embodiment of the invention set forth above. A variety of modifications or alterations of the illustrated embodiment will nevertheless occur to the specialists with the broad teaching hereof. For instance, in each set of ink-jet printers 6 or 7, two or more printers may be aligned transversely of the web as required by the width of the printings to be made. It is before appropriate that the invention be construed broadly and in a manner consistent with the fair meaning or proper scope of the subjoined claims.

What is claimed is:

1. A double-side printing apparatus for printing both sides of a continuous web of paper, comprising:

an infeed mechanism operable to supply a continuous web of paper to be printed;

a first printing unit operable to print on a first side of the continuous web of paper supplied by said infeed mechanism;

a second printing unit operable to print on a second side of the continuous web of paper supplied by said infeed mechanism, said first printing unit and said second printing unit being spaced apart and stacked in a vertical direction;

a guide mechanism operable to guide the continuous web of paper along a travel path contained in a plane extending in the prescribed direction, and to guide the continuous web of paper past said first printing unit and past said second printing unit in succession along the travel path while the continuous web of paper travels in a single direction with respect to the travel path, whereby the continuous web of paper is printed on the first side and the second side; and only one drier zone for drying printings on the continuous web of paper, said drier zone being stacked in a vertical direction with said first printing unit and said second printing unit such that a first one of said first printing unit and said second printing unit is arranged between said drier zone and a second one of said first printing unit and said second printing unit, said drier zone including:

a first drier between said first printing unit and said second printing unit with respect to the travel path, said first drier being operable to dry printings formed on the first side of the continuous web of paper by said first printing unit; and a second drier downstream of said second printing unit with respect to the travel path, said second drier being operable to dry printings formed on the second side of the continuous web of paper by said second printing unit.

2. The apparatus of claim 1, wherein the prescribed direction comprises a first direction with respect to said infeed mechanism, said guide mechanism being operable to guide the continuous web of paper along the travel path past said first printing unit in a second direction with respect to said infeed mechanism, and past said second printing unit in a third direction with respect to said infeed mechanism, wherein the second direction is different than the first direction, and wherein the second direction is opposite the third direction.

3. The apparatus of claim 1, wherein each of said first drier and said second drier comprises a drum and forms a portion of said guide mechanism.

4. The apparatus of claim 1, further comprising a delivery mechanism for receiving the continuous web of paper after the continuous web of paper supplied by said infeed mechanism has been printed on by said first printing unit and said second printing unit, successively.

5. A double-side printing apparatus for printing both sides of a continuous web of paper, comprising:

an infeed mechanism operable to supply a continuous web of paper to be printed;

a first printing unit operable to print on a first side of the continuous web of paper supplied by said infeed mechanism;

a second printing unit operable to print on a second side of the continuous web of paper supplied by said infeed mechanism, said first printing unit and said second printing unit being stacked in a vertical direction;

a delivery mechanism for receiving the continuous web of paper after the continuous web of paper supplied by said infeed mechanism has been printed by said first printing unit and said second printing unit, said second printing unit being spaced apart from said first printing unit in a plane containing said infeed mechanism and said delivery mechanism, and a set of guide rollers operable to guide the continuous web of paper along a travel path contained in the plane past said first printing unit in a first direction with respect to said infeed mechanism and past said second printing unit in a second direction with respect to said infeed mechanism, the first direction being opposite to the second direction, and operable to guide the continuous web of paper along the travel path such that the continuous web of paper travels in a single direction with respect to the travel path, whereby the continuous web of paper is printed on the first side and the second side; and only one drier zone for drying printings on the continuous web of paper, said drier zone being stacked in a vertical direction with said first printing unit and said second printing unit such that a first one of said first printing unit and said second printing unit is arranged between said drier zone and a second one of said first printing unit and said second printing unit, said drier zone including:

a first drier between said first printing unit and said second printing unit with respect to the travel path, said first drier being operable to dry printings formed on the first side of the continuous web of paper by said first printing unit; and a second drier downstream of said second printings unit with respect to the travel path, said second drier being operable to dry printings formed on the second side of the continuous web of paper by said second printing unit.

6. The apparatus of claim 5, wherein each of said first drier and said second drier comprises a drum and forms one of said guide rollers.

7. A double-side ink-jet printing apparatus for printing both sides of a continuous web of paper, comprising:

an infeed mechanism operable to supply a continuous web of paper to be printed;

a first set of aligned ink-jet printers operable to print on a first side of the continuous web of paper supplied by said infeed mechanism;

a second set of aligned ink-jet printers operable to print on a second side of the continuous web of paper supplied by said infeed mechanism, said second set of aligned ink-jet printers and said first set of aligned ink-jet printers being spaced apart and stacked in a vertical direction in a plane containing said infeed mechanism; and a guide mechanism operable to guide the continuous web of paper along a travel path contained in the plane past said first set of aligned ink-jet printers in a first direction with respect to said infeed mechanism and past said second set of aligned ink-jet printers in a second direction with respect to said infeed mechanism, the first direction being opposite to the second direction, and operable to guide the continuous web of paper along the travel path such that the continuous web of paper travels in a single direction with respect to the travel path, whereby the continuous web of paper is printed on the first side and the second side; and only one drier zone for drying printings on the continuous web of paper, said drier zone being stacked in a vertical direction with said first set of aligned ink-jet printers and said second set of aligned ink-jet printers such that a first one of said first set of aligned ink-jet printers and said second set of aligned ink-jet printers is arranged between said drier zone and a second one of said first set of aligned ink-jet printers and said second set of aligned ink-jet printers, said drier zone including:

a first drier between said first set of aligned ink-jet printers and said second set of aligned ink-jet printers with respect to the travel path, said first drier being operable to dry printings formed on the first side of the continuous web of paper by said first set of aligned ink-jet printers; and a second drier downstream of said second set of aligned ink-jet printers with respect to the travel path, said second drier being operable to dry printings formed on the second side of the continuous web of paper by said second set of aligned ink-jet printers.

8. The apparatus of claim 7, wherein said first set of aligned ink-jet printers is parallel to said second set of aligned ink-jet printers, and said ink-jet printers are oriented if so as to face in the same direction.

9. The apparatus of claim 7, wherein each of said first drier and said second drier comprises a drum and forms a portion of said guide mechanism.

* * * * *